US006299482B1

(12) United States Patent
Huang

(10) Patent No.: US 6,299,482 B1
(45) Date of Patent: Oct. 9, 2001

(54) DIGITAL CONNECTOR RETAINING DEVICE

(76) Inventor: Tien Yu Huang, P.O. Box 26-757, Taipei (TW)

( * ) Notice: Subject to any disclaimer, the term of this patent is extended or adjusted under 35 U.S.C. 154(b) by 0 days.

(21) Appl. No.: 09/694,800

(22) Filed: Oct. 20, 2000

(30) Foreign Application Priority Data

Mar. 24, 2000 (TW) ..... 89204745 U

(51) Int. Cl.[7] ..... H01R 13/648
(52) U.S. Cl. ..... 439/607
(58) Field of Search ..... 439/607, 609, 439/564, 573

(56) References Cited

U.S. PATENT DOCUMENTS 5,288,244 * 2/1994 Lien ..... 439/607
5,800,207 * 9/1998 Hsu et al. ..... 439/541.5
6,146,201 * 11/2000 Chen ..... 439/607

* cited by examiner

*Primary Examiner*—Tulsidas Patel
(74) *Attorney, Agent, or Firm*—Rosenberg, Klein & Lee

(57) ABSTRACT

A digital connector retaining device comprises an insulating body, a metal casing and two buckles. The insulating body has two sides each formed with a through hole. A plurality of conductive terminals are installed within the insulating body and one end of the conductive terminal protrudes out of the insulating body. The metal casing installed at a front side of the insulating body. Two sides of the metal casing each are formed with a retaining post. A through hole is installed within the retaining post. A rear end thereof is formed with at least one notch; and the metal casing covers on the insulating body. The two buckles are installed at two sides of the insulating body. Each of the buckles is installed with a through hole. The two retaining posts of the metal casing are matched to the two through holes of the two buckles; and rear ends of two retaining posts are combined with the buckles by riveting connection. In the present invention, at least one notch is installed at one end of the retaining post for removing stress force in rivet connection so that it can effectively prevent the outer lateral portions of the two through holes of the insulating body from cracking. Therefore, the yield ratio of the product is increased and the manufacturing cost is reduced.

5 Claims, 6 Drawing Sheets

DIGITAL CONNECTOR RETAINING DEVICE

FIELD OF THE INVENTION

The present invention relates to a digital connector retaining device, and especially to digital connector can improve yield ratio greatly.

BACKGROUND OF THE INVENTION

As shown in FIG. 1, a prior art digital connector is illustrated. The digital connector includes an insulating body 10*a,* a metal casing 11*a,* two buckles 12*a,* two positioning piece 13*a,* and two retaining pieces 14*a*. The insulating body 10*a* is made of plastics and other insulating materials, and two sides thereof each are installed with a through hole 15*a* for receiving the two retaining pieces 14*a*. The metal casing 11*a* is an iron casing and made by punching. The metal casing is installed in front of the insulating body 10*a*. Two sides of the metal casing 11*a* are installed with through holes 16*a* which is correspondent to the through holes 15*a* of the insulating body 10*a*. The two buckles 12*a* are installed at two sides of the insulating body 10*a*. The upper end of each buckle 12*a* is formed with a through hole 17*a*. The two positioning pieces 13*a* each are installed with a through hole 18*a*. The two retaining pieces 14*a* are matched to the through holes 16*a,* 15*a,* 17*a,* and 18*a* of the metal casing 11*a,* insulating body 10*a,* two buckles 12*a* and two positioning pieces 13*a*. The front end and rear end of the two retaining pieces 14*a* are riveted so that the front end and rear end of the retaining piece 14*a* are connected to the metal casing 11*a* and positioning piece 13*a* by riveting connection. Thus, the insulating body 10*a,* metal casing 11*a,* two buckles 12*a* and two positioning pieces 13*a* are firmly secured as an integral body. Thereby, the metal casing 11*a* and two buckles 12*a* are fixed to the insulating body 10*a*. The lower end of each two buckles 12*a* has a buckling portion 19*a* for being engaged to the circuit board. The metal casing 11*a* covers on the outer side of the inserting portion 20*a* of the insulating body 10*a*. Two screw means 21*a* serve to be screwedly connected within the two retaining pieces 14*a* for being fixed to the front end of the metal casing 11*a*. A plurality of channels 22*a* are installed within the insulating body 10*a*. Each channel 22*a* is matched with a conductive terminal (not shown). The lower end of the conductive terminal protrudes out of the bottom of the insulating body 10*a* so as to be electrically connected to a circuit board.

However, in aforesaid prior art digital connector, as the two retaining pieces 14*a* are connected to the metal casing 11*a* and positioning pieces 13*a* by riveting connection, a stress force will generate so that the outer portions 23*a* of two through holes 15*a* of the insulating body 10*a* will crack and thus the yield ratio of the product is decreased greatly. Therefore, the manufacturing cost can not be reduced. If it is want to avoid this event, it is needed to increase the thickness of the outer portion 23*a* of two through holes 15*a,* but this will cause that the whole width and volume of the connector are increased. Other than more plastic materials are required, it remain not to meet the requirement of compact of current trend.

SUMMARY OF THE INVENTION

Accordingly, the primary object of the present invention is to provide a digital connector retaining device, wherein at least one notch is installed at one end of the retaining post for removing stress force in rivet connection so that it can effectively prevent the outer lateral portions of the two through holes of the insulating body from cracking.

Therefore, the yield ratio of the product is increased and the manufacturing cost is reduced.

Another object of the present invention is to provide a digital connector retaining device, wherein the outer lateral portions of the two through hole of the insulating body suffer from no stress force force and thus it is impossible to crack out. Therefore, it is unnecessary to increase the thickness of the outer lateral portions of the two through holes. Thus, the thickness of the outer lateral portions of the two through hole can be reduced so that the width and volume of the connector is decreased. Therefore, the material required is saved. A compact design is achieved.

A further object of the present invention is to provide a digital connector retaining device, wherein the metal casing is made of zinc-aluminum alloy material without rusting and thus it may suffer from a heavy load and is difficult to be damaged. Furthermore, the metal casing is made of injection molding without bending, and deforming. Furthermore, it has a better precision. Accordingly, the quality of the products is improved.

To achieve the aforesaid object, the present invention provides a digital connector retaining device comprising an insulating body, a metal casing and two buckles. The insulating body has two sides each formed with a through hole. A plurality of conductive terminals are installed within the insulating body and one end of the conductive terminal protrudes out of the insulating body. The metal casing installed at a front side of the insulating body. Two sides of the metal casing each are formed with a retaining post. A through hole is installed within the retaining post. A rear end thereof is formed with at least one notch; and the metal casing covers on the insulating body. The two buckles are installed at two sides of the insulating body. Each of the buckles is installed with a through hole. The two retaining posts of the metal casing are matched to the two through holes of the two buckles; and rear ends of two retaining posts are combined with the buckles by riveting connection. In the present invention, at least one notch is installed at one end of the retaining post for removing stress force in rivet connection so that it can effectively prevent the outer lateral portions of the two through holes of the insulating body from cracking. Therefore, the yield ratio of the product is increased and the manufacturing cost is reduced.

The various objects and advantages of the present invention will be more readily understood from the following detailed description when read in conjunction with the appended drawing.

DETAILED DESCRIPTION OF THE PREFERRED EMBODIMENTS

Figure 1:
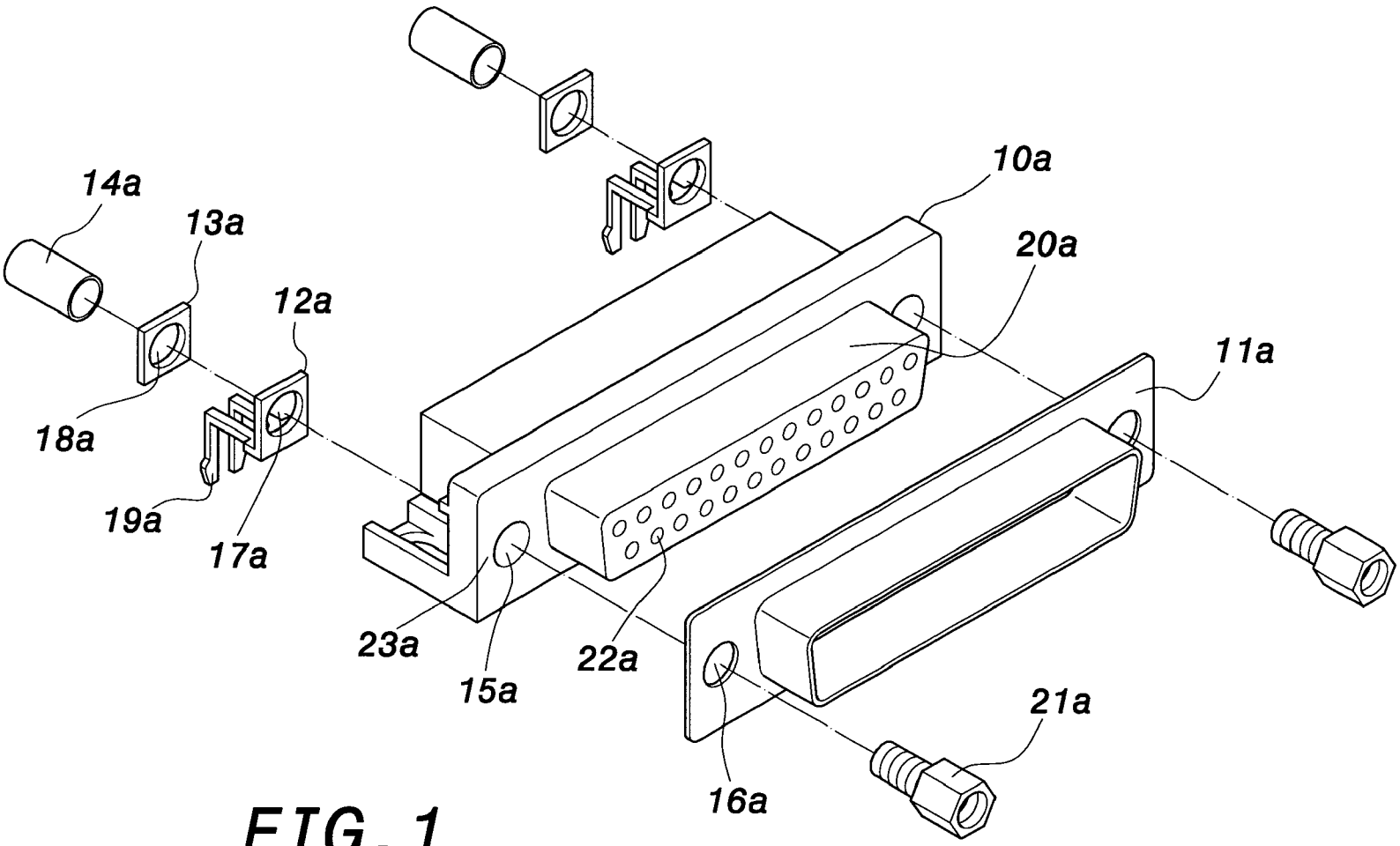
FIG. 1 PRIOR ART
FIG. 1 is an exploded perspective view of a prior art digital connector retaining device.
Figure 2:
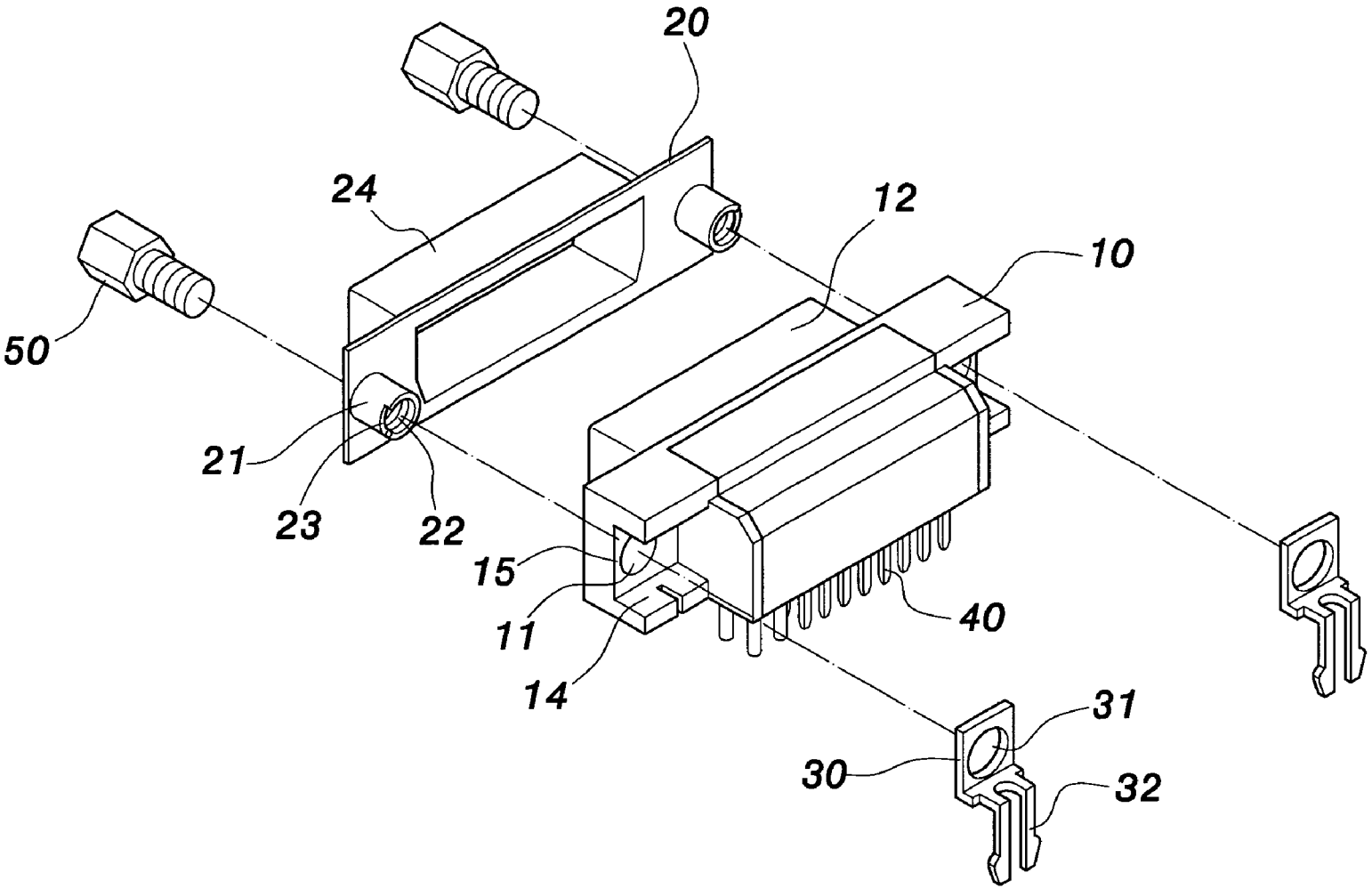
FIG. 2 is an exploded perspective view of the present invention.
Figure 3:
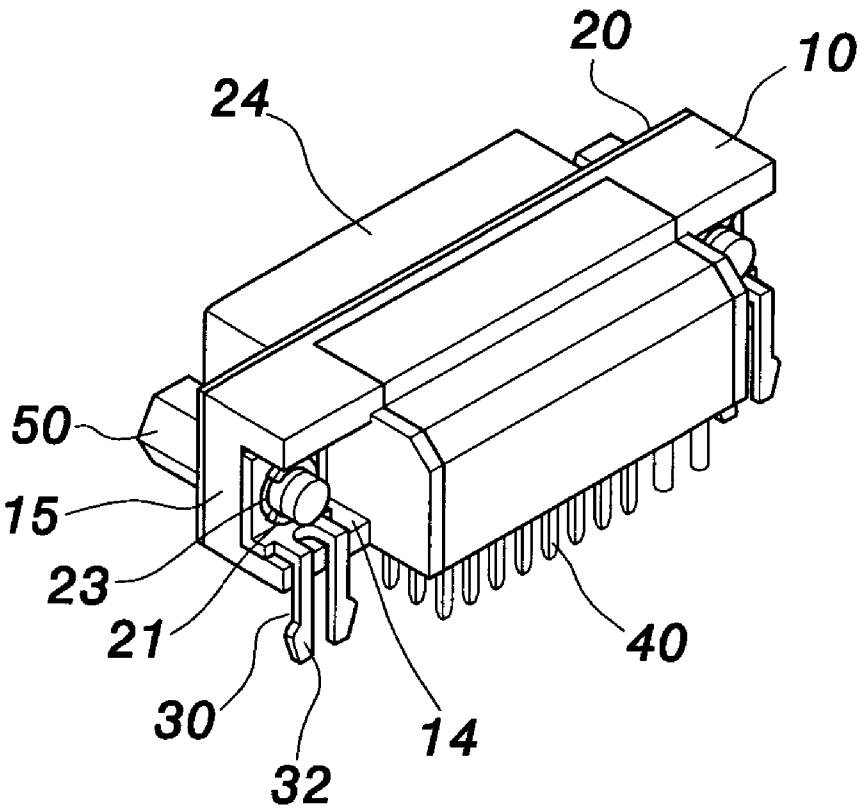
FIG. 3 is an assembled perspective view of the present invention.

Referring to FIGS. 2 and 3, a digital connector retaining device of the present invention is illustrated. The digital connector retaining device includes an insulating body 10, a metal casing 20, and two buckles 30. The insulating body 10 is made of plastics or other insulating materials. Each of two sides thereof is formed with a through hole 11. A front end of the insulating body 10 is formed with an inserting portion 12 for being connected to a matched connector. A plurality of channels (not shown) are formed in the inserting portion 12. Each of the channels is matched with a conductive terminal 40. Each of the conductive terminal 40 has an end extending out of the bottom of the insulating body 10 for being electrically connected to a circuit board. Each of two sides of the insulating body 10 is installed with a rectangular hole 14.

The metal casing 20 is made of zinc-aluminum alloy material and is made by injection molding. The metal casing 20 is installed at a front side of the insulating body 10. Each of two sides of the metal casing 20 is installed with a retaining post 21 with respect to the through holes 11 at two sides of the insulating body 10 for replacing the prior art retaining pieces. A through hole 22 is installed in the retaining post 21. The through hole 22 is formed with thread. A rear end the retaining post 21 has at least one notch 23. The front side of the metal casing 20 is protruded with a hollow cover 24. The cover 24 has a shape with respect to the outlook of the inserting portion 12 of the insulating body 10 so that it can cover the outer side of the inserting portion 12.

Two buckles 30 are installed at two sides of the insulating body 10. An upper end of the buckle 30 has a rectangular shape which has a through hole 31. The lower end of each of the two buckles 30 has a buckles 32 and the upper end thereof is matched to the hole 14 at each side of the insulating body 10.

The two retaining posts 21 of the metal casing 20 are matched to the through holes 11 and 31 of the insulating body 10 and the two buckles 30. The rear end of each retaining post 21 is riveted so that the rear end of the retaining post 21 is combined with the buckle 30 by riveting connection. Therefore, the insulating body 10, metal casing 20 and two buckles 30 are combined as an integral body. Thus, the metal casing 20 and two buckles 30 are fixed to the insulating body 10. The two buckles 30 serve to be fixed to a circuit board. Two screws 50 are screwedly connected to the through hole 22 of the two retaining posts 21 so as to be conveniently locked to a mated connector. By aforementioned components, a digital connector retaining device of the present invention is formed.

The digital connector retaining device of the present invention only includes an insulating body 10, a metal casing 20 and two buckles 30. The components are reduced greatly and it has a simple structure so that the assembly work is convenient and the manufacturing cost is effectively reduced. Furthermore, the metal casing 20 is made of zinc-aluminum alloy material without rusting, bending, and deforming. Furthermore, it has a better precision. Accordingly, the quality of the products is improved.

In the present invention, the rear end of each retaining post 21 is installed with a notch 23. The rear end of each retaining post 21 is riveted. As it is combined with the buckles 30 by riveting connection, the notch 23 serves to remove stress force so that it can effectively prevent the outer lateral portions 15 of the two through holes 11 of the insulating body 10 from cracking. Therefore, the yield ratio of the product is increased and the manufacturing cost is reduced. The outer lateral portions 15 of the two through hole 11 of the insulating body 10 suffer from no stress force and thus it is impossible to crack out. Therefore, it is unnecessary to increase the thickness of the outer lateral portions 15 of the two through holes 11. Thus, the thickness of the outer lateral portions 15 of the two through hole 11 can be reduced so that the width and volume of the connector is decreased. Therefore, the material required is saved. A compact design is achieved.

Figure 4:
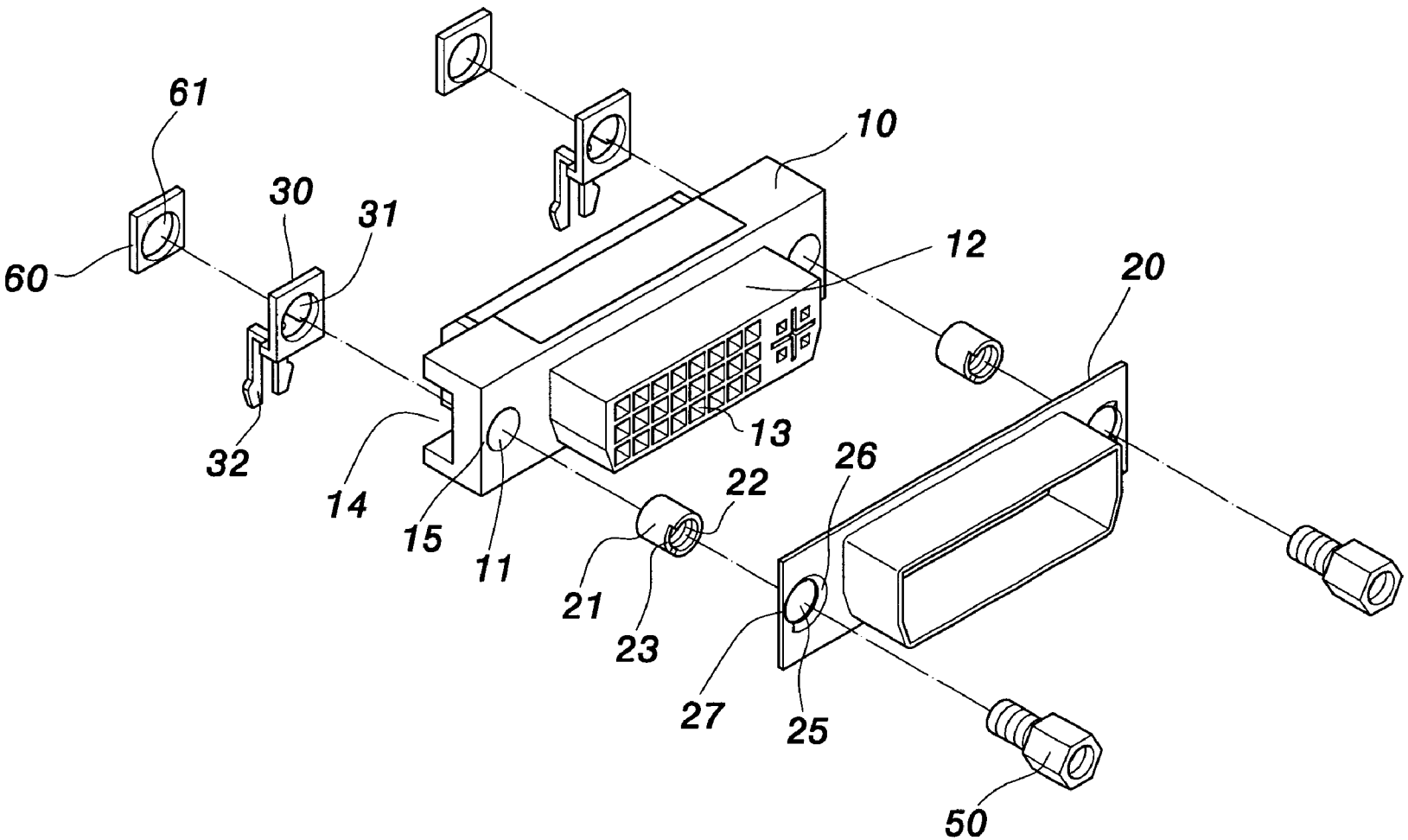
FIG. 4 is an exploded perspective view of another embodiment in the present invention.
Figure 5:
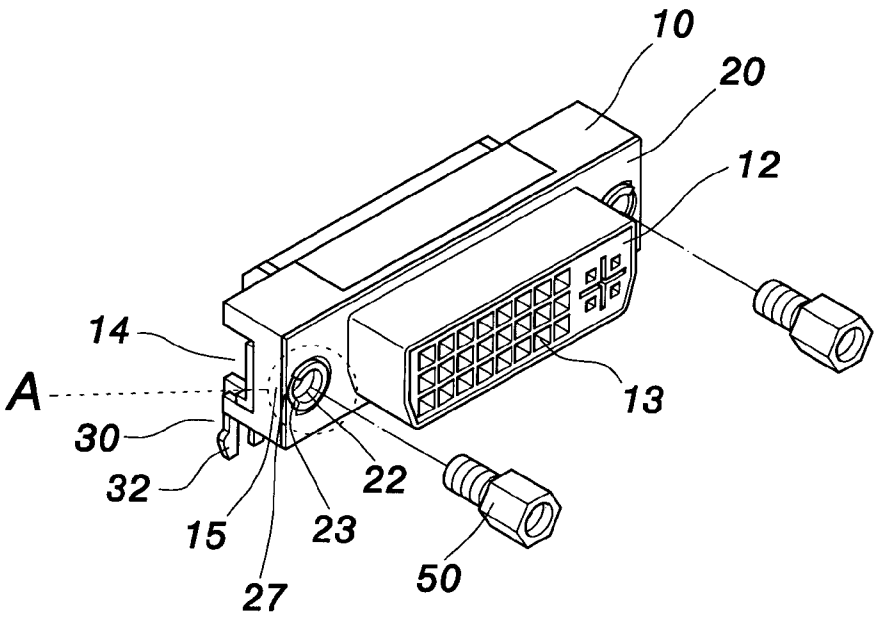
FIGS. 5 and 5A are an assembled perspective view of another embodiment in the present invention.
Figure 5A:
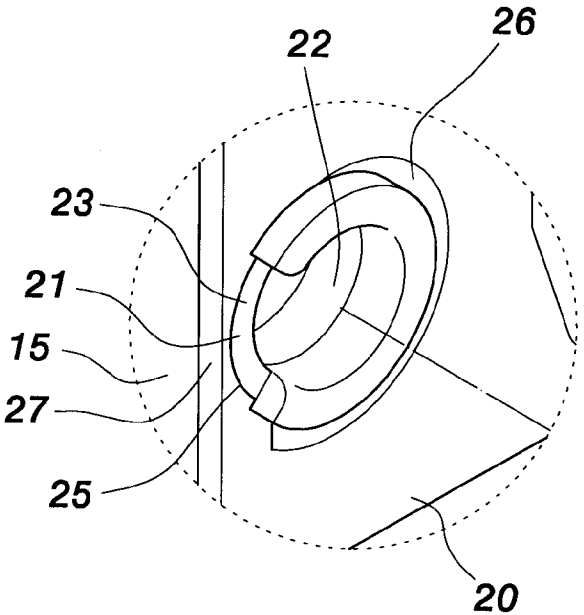

Furthermore, referring to FIGS. 4, 5 and 5A, in the present invention, the retaining posts 21 at two sides of the metal casing 20 are assembled. Namely, two retaining posts 21 and the metal casing 20 are separated and then are combined. In that, each side of the metal casing 20 is installed with a connecting hole 25. A front end of each retaining post 21 is installed with at least one notch 23. Furthermore, a front end of the connecting hole 25 is installed with a chamfer 26. The chamfer 26 is correspondent to the portion out of the notch 23 at the front end of the retaining post 21 for receiving the front end of the retaining post 21. The rear side of each of the buckles 30 is installed with a positioning piece 60. The positioning piece 60 has a rectangular shape each of which is installed with a through hole 31. The two retaining posts 21 are matched to the connecting holes 25 of the metal casing 20, the through hole 11 of the insulating body 10, the through holes 31 of the buckles 30, and the through holes 61 of the two positioning pieces 60. The front and rear end of each retaining post 21 are riveted so that the front end and rear end of the retaining post 21 are combined with the metal casing 20 and the positioning pieces 60. Therefore, the insulating body 10, metal casing 20 and two buckles 30 are connected as an integral body. Thereby, the metal casing 20 and two buckles 30 are fixed to the insulating body 10. In the present invention, the front end of the retaining post 21 is installed with a notch 23, as the front end of the retaining post 21 is riveted so as to be combined with the metal casing 20, the notch 23 serves to remove the stress force therebetween so as to prevent the outer lateral portions 15 of the two through holes 11 of the insulating body 10 and the outer lateral portions 27 of the connecting holes 25 of the metal casing 20 from cracking.

Figure 6:
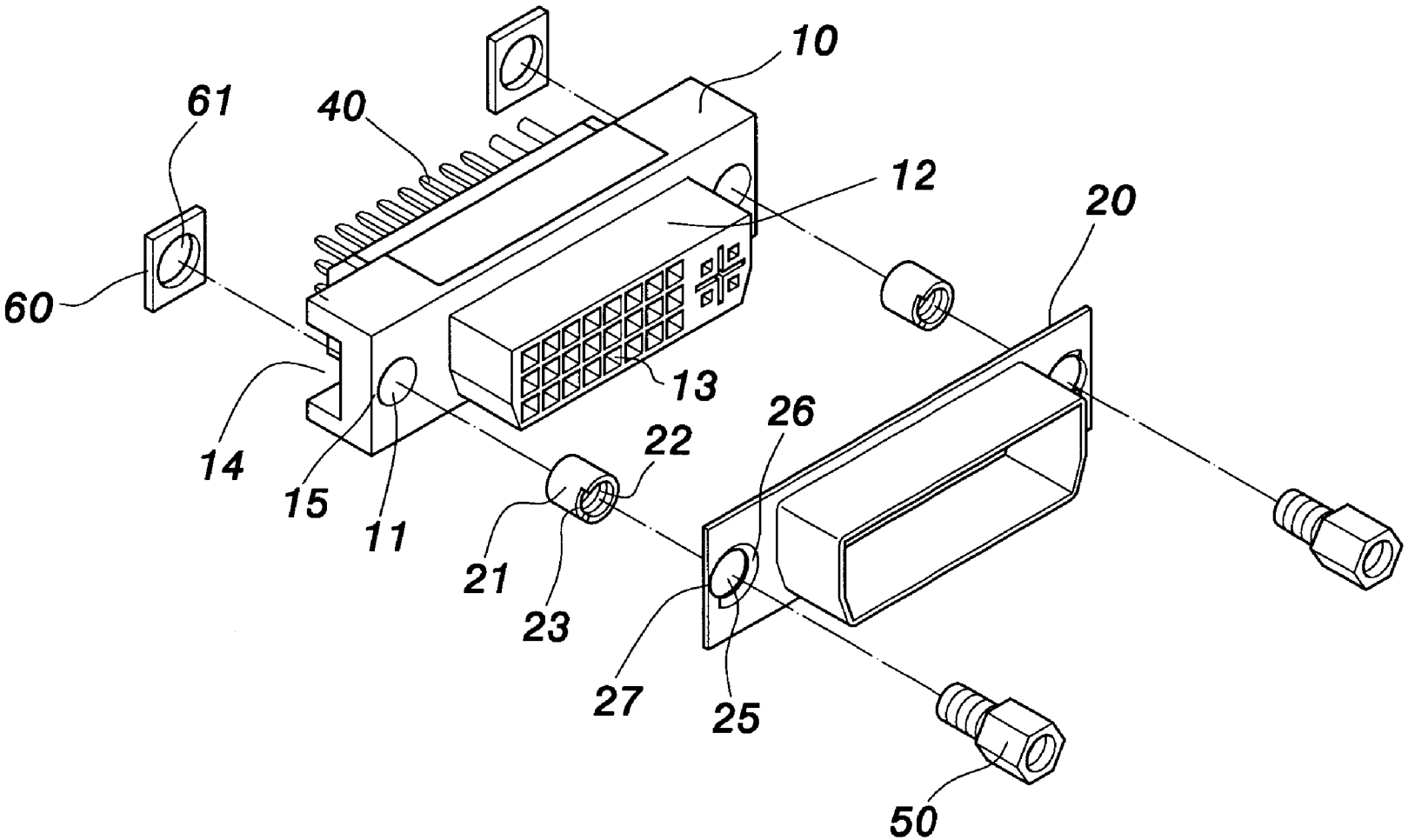
FIG. 6 is an exploded perspective view of a further embodiment in the present invention.

Moreover, as shown in FIG. 6, one end of the conductive terminal 40 in the channel 13 of the insulating body 10 may protrude out of the rear side of the insulating body 10. In this embodiment, no buckle is necessary. The two positioning pieces 60 have a rectangular shape and the two positioning pieces 60 are installed at the holes 14 in the two sides of the insulating body 10. The two retaining posts 21 are matched to the through holes 11 of the connecting holes 25 of the metal casing 20, and the through holes 61 of the two positioning pieces 60. The front end and rear end of each retaining post 21 is riveted so that the front end and rear end of the retaining post 21 is combined with the metal casing 20 and positioning pieces 60 by riveting connection. Therefore, the insulating body 10 and the metal casing 20 are combined as an integral body.

In summary, the defects in the prior art digital connector retaining device, such as a stress force occurs when the two retaining pieces, metal casing, and positioning pieces are combined by riveting connection, so that the outer lateral portions of two through holes of the insulating body cracks and thus the yield ratio is reduced greatly and the cost is increased. Moreover, the outer lateral portions of the two through holes must have a large thickness so that the width and volume of the circuit is enlarged, and thus, more material is necessary. As a result, the product can not made more compact. However, the aforesaid defects can be improved by the present invention.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A digital connector comprising:

an insulating body having two sides each formed with a respective through hole, the insulating body having a plurality of channels formed therein with a plurality of conductive terminals respectively disposed in the channels, one end of each of the plurality of conductive terminals protruding out of the insulating body;

a metal casing mounted on a front side of the insulating body, two sides of the metal casing each having a retaining post respectively coupled thereto, the retaining posts respectively extend through the through holes of the insulating body, each retaining post having a through hole formed therein, a rear end of each of the retaining posts being formed with at least one notch disposed adjacent a side of the fixing post coinciding with an outer side of the insulating body; and two buckles installed at two sides of the insulating body, each of the buckles being formed with a respective through hole, the two retaining posts of the metal casing pass through the two through holes of the two buckles and being secured by the rear ends of two retaining posts being riveted, the notch in each retaining post preventing the riveting from stressing a corresponding outer side of the insulating body.

2. A digital connector comprising:

an insulating body having two sides each formed with a respective through hole, the insulating body having a plurality of channels formed therein with a plurality of conductive terminals respectively disposed in the channels, one end of each of the plurality of conductive terminals protruding out of the insulating body;

a metal casing covering a front side of the insulating body, the metal casing having two lateral sides each respectively formed with a connecting hole;

two retaining posts each having a through hole extending between opposing front and rear ends thereof, the front end of each retaining post having at least one notch formed therein;

two buckles installed at two sides of the insulating body, each of the buckles being formed with a respective through hole; and two positioning pieces respectively disposed adjacent rear sides of the two buckles, each of the positioning pieces having a through hole formed therein, the two retaining posts each extend through a respective one of the connecting holes of the metal casing, the through holes of the insulating body, the through holes of the two buckles and the through holes of the two positioning pieces, wherein the metal casing, the insulating body, the two buckles and the two positioning pieces being joined by riveting of the front end and the rear end of each retaining post, the notch in each retaining post being disposed adjacent a side of the fixing post coinciding with an outer side of the insulating body to thereby prevent the riveting from stressing the outer side of the insulating body.

3. The digital connector as claimed in claim 2, wherein each connecting hole of the metal casing has a chamfered edge portion formed on a front side of the metal casing, the chamfered edge portion being in correspondence to an unnotched portion of the front end of a respective one of the retaining posts for receiving a corresponding riveted front end portion of the retaining post.

4. A digital connector comprising:

an insulating body having two sides each formed with a respective through hole, the insulating body having a plurality of channels formed therein with a plurality of conductive terminals respectively disposed in the channels, one end of each of the plurality of conductive terminals protruding out of the insulating body;

a metal casing covering a front side of the insulating body, the metal casing having two lateral sides each respectively formed with a connecting hole;

two retaining posts each having a through hole extending between opposing front and rear ends thereof, the front end of each retaining post having at least one notch formed therein; and two positioning pieces respectively disposed two sides of the insulating body, each of the positioning pieces having a through hole formed therein, the two retaining posts each extend through a respective one of the connecting holes of the metal casing, the through holes of the insulating body, and the through holes of the two positioning pieces, wherein the metal casing, the insulating body, and the two positioning pieces being joined by riveting of the front end and the rear end of each retaining post, the notch in each retaining post being disposed adjacent a side of the fixing post coinciding with an outer side of the insulating body to thereby prevent the riveting from stressing the outer side of the insulating body.

5. The digital connector as claimed in claim 4, wherein each connecting hole of the metal casing has a chamfered edge portion formed on a front side of the metal casing, the chamfered edge portion being in correspondence to an unnotched portion of the front end of a respective one of the retaining posts for receiving a corresponding riveted front end portion of the retaining post.

* * * * *